United States Patent [19]

Oshima et al.

[11] Patent Number: 5,017,826

[45] Date of Patent: May 21, 1991

[54] RAPID HEAT-DISSIPATING TYPE SPARK PLUG FOR INTERNAL COMBUSTION ENGINES

[75] Inventors: Takafumi Oshima; Kozuka Kazuhiko, both of Nagoya, Japan

[73] Assignee: NGK Spark Plug Co., Ltd., Nagoya, Japan

[21] Appl. No.: 397,101

[22] Filed: Aug. 21, 1989

[30] Foreign Application Priority Data

Jan. 9, 1989 [JP] Japan ..... 1-2370
Jan. 9, 1989 [JP] Japan ..... 1-2371

[51] Int. Cl.[5] ..... H01T 13/20

[52] U.S. Cl. ..... 313/142; 313/141; 123/169 EL

[58] Field of Search ..... 313/141, 143, 142; 123/169 EL

[56] References Cited

U.S. PATENT DOCUMENTS 4,539,503 9/1985 Esper et al. ..... 313/141
4,814,665 3/1989 Sakura et al. ..... 313/141

*Primary Examiner*—Sandra L. O'Shea
*Assistant Examiner*—John Giust
*Attorney, Agent, or Firm*—Cooper & Dunham

[57] ABSTRACT

A rapid heat-dissipating type spark plug has a metallic shell which is made of material having a tensile stress of more than 40 Kg/mm$^2$ with a thermal conductivity of more than 60 W/m·k.

In another embodiment, there is provided a ground electrode which is made of nickel or nickel alloy.

The ground electrode is connected to the metallic shell through a metallic ring which is made of different metal from the metallic shell such as steel, stainless steel or nickel alloy.

7 Claims, 8 Drawing Sheets

RAPID HEAT-DISSIPATING TYPE SPARK PLUG FOR INTERNAL COMBUSTION ENGINES

BACKGROUND OF THE INVENTION

1. Field of the Invention

The invention relates to a spark plug structure in use for internal combustion engine, and particularly concerns to a spark plug improved in heat-resistance and fouling resistance.

2. Description of Prior Art

In a spark plug generally used for internal combustion engine, there are provided a metallic shell having a male thread at its outersurface and an insulator into which a center electrode is placed. The metallic shell is made of steel carbide, while the insulator has been mainly made of alumina porcelain. The physical properties of these materials such as thermal conductivity, have been playing important roles in determining thermal characteristics of a spark plug. The characteristics represents heat-resistance which indicates preignition resistance at high temperature atmosphere, and at the same time, representing fouling resistance which indicates carbon formation at low temperature atmosphere.

Therefore, it has been desired to provide a performance-enhanced spark plug which is capable of complying with versatile demands with high output of recent engine and low fuel consumption.

Therefore, it is an object of this invention to provide a spark plug structure which is capable of avoiding preignition, and imparting good thermal transfer from an insulator to a metallic shell with good heat-resistance.

It is another object of this invention to provide a spark plug structure which is capable of determining greater insulation path by lowering the temperature of an insulator with improved fouling resistance.

It is further object of this invention to provide a spark plug structure which is capable of maintaining high mechanical strength and air-tightness.

According to the present invention, there is provided a spark plug structure comprising; a cylindrical metallic shell; a tubular insulator having a center bore, and a center electrode placed into the center bore of the insulator to form a spark gap with a ground electrode depending from the metallic shell; the metallic shell being made of material having a tensile stress of more than 40 $Kg/mm^2$, and having a thermal conductivity of more than 60 W/m·k.

Various other objects and advantages be obtained by the present invention will appear in the following description and in the accompanying drawings.

According further to the invention, there is provided a spark plug structure comprising; a cylindrical metallic shell having a ground electrode at its front end which has a thermal conductivity of more than 60 W/m·k; an tubular insulator having a center bore, and at least a front end of the insulator having a good thermal conductivity of more than 60 W/m·k and placed into the metallic shell; a center electrode placed into the center bore of the insulator with a front end somewhat extended from that of the insulator; a terminal inserted into the center bore of the insulator in alignment with the center electrode; an electrically conductive glass sealant provided at an annular space between the insulator and the terminal, and one between the insulator and the center electrode; the ground electrode being made of nickel or nickel alloy, the ground electrode being connected to the metallic shell through a metallic ring which is made of different metal from the metallic shell such as steel, stainless steel or nickel alloy.

DETAILED DESCRIPTION OF THE INVENTIOn

Figure 1:
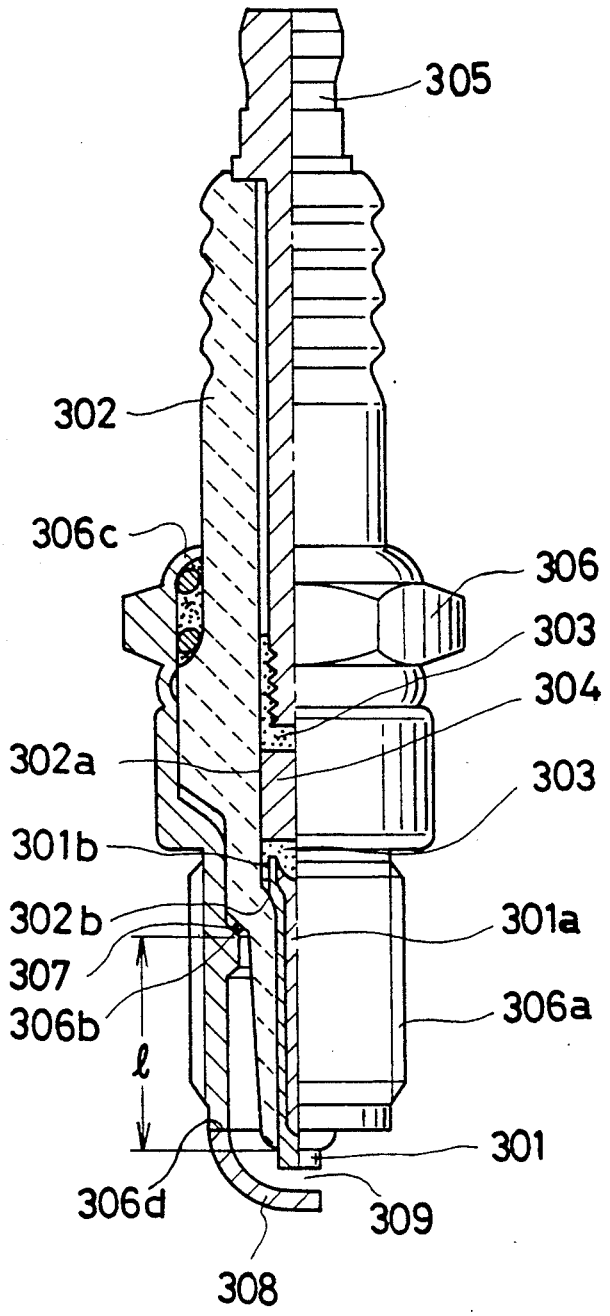
FIG. 1 is a plan view of a spark plug but partly broken.

Referring to FIG. 1 in which a spark plug is shown, the spark plug has a center electrode 301 having a copper core 301*a* clad by a nickel. A tubular insulator 302 has an axial bore 302*a* into which the center electrode 301 is placed with a flanged head 301*b* engaged against a step 302*b*. The flanged head 301*a* sandwiches a resistor 304 by an electrical conductor glass sealant 303 by way of a terminal electrode 305. A metallic shell 306 has a male thread 306*a* at its outer surface. Into the metallic shell 306, the insulator 302 is placed with a packing 307 seated on a step 306*b*. A rear part 306*c* of the metallic shell 306 is inturned for the purpose fixing by means of caulking. A spark gap 309 is formed between the center electrode 301 and an outer electrode 308 depended from an upper end 306*d* of the metallic shell 306.

In this embodiment of the present invention, the metallic shell 306 has a tensile stress of more than 40 $Kg/mm^2$, with a thermal conductivity of more than 60 W/m·k. An insulator has a withstand voltage of more than 10 KV and a bending strength of more than 15 $Kg/mm^2$ with the thermal conductivity of more than 60 W/m·k.

Copper alloys of the metallic shell is selected from specimens A -G at Table 1, while aluminum alloys of the insulator is selected from specimens H -K at Table 2. Among the specimens, the copper alloys A -F are found to be sufficient for this invention, while aluminum alloy specimens I, K are acceptable for this invention.

Heat resistant experiment has conducted with thre conventional spark plugs (BPR5ES) employed to compare a spark plug which has a metallic shell made of specimens F, K and employed an alumina insulator.

TABLE 1

| | | chemical component (wt %) | | | | characteristics | | | | | |
|---|---|---|---|---|---|---|---|---|---|---|---|
| | involved rating | Be | Ni + Co | Ni + Co + Fe | Ni + Co + Fe + Cu | density | thermal conductivity | electrical conductivity | tensile stress | hardness | references |
| material A | ASTM B196 C17200 | 1.80–2.00 | above 0.20 | below 0.6 | above 99.5 | 8.26 | 83–130 | 22% IACS | 123–150 kg/mm² | 330–430 Hv | ageing treatment |
| material B | ASTM B441 C17500 | 0.4–0.7 | 2.35–2.70 | — | ↑ | 8.75 | 167–259 | 48 | 77–97 | 230–280 | ageing treatment |
| material C | ASTM B441 C17510 | 0.2–0.6 | 1.40–2.20 | — | ↑ | 8.75 | 167–259 | 50 | 77–97 | 230–280 | ageing treatment |
| material D | — | 0.3 | Ni 1.5 | — | residual Cu | 8.90 | 188–271 | 55 | 77–90 | 220–280 | ageing treatment |
| material E | — | 0.6 | Co 2.5 | — | ↑ | 8.75 | 167–259 | 50 | 75–95 | 220–280 | ageing treatment |
| material F | copper chromium (0.6–1.2 Cr) | — | — | — | — | 8.90 | 334 | 78 | 60 | 180 | ageing treatment |
| material G | pure copper JIS C1020 | — | — | — | pure copper | 8.90 | 389 | 100 | 35 | 70 | — |

TABLE 2

| | involved rating | specimen H JISA 1100 H14 | specimen I JISA 7075 T6 | specimen J JISA 2024 T4 | specimen K JISA 2011 T8 |
|---|---|---|---|---|---|
| chemical component (wt %) | Si | Si + Fe | below 0.40 | 0.50 | 0.40 |
| | Fe | below 1.0 | below 0.50 | 0.50 | 0.70 |
| | Cu | 0.05–0.20 | 1.7–2.0 | 3.8–4.9 | 5.0–6.0 |
| | Mn | below 0.05 | below 0.30 | 0.3–0.9 | — |
| | Mg | — | 2.1–2.9 | 1.2–1.8 | — |
| | Cr | — | 0.18–0.28 | 0.10 | — |
| | Zn | below 0.10 | 5.1–61 | 0.25 | 0.3 |
| | | — | Zr + Ti below 0.25 | Zr + Ti below 0.20 | Pb 0.2–0.6 Bi 0.2–0.6 |
| | Ti | — | below 0.2 | — | — |
| | Al | above 99.0 | Bal | Bal | Bal |
| characteristics | density | 2.71 | 2.80 | 2.77 | 2.82 |
| | thermal conductivity | 222 | 130 | 121 | 171 |
| | electrical conductivity | 59% | 33% | 30% | 45% |
| | tensile stress | 12.5 | 57.7 | 43.0 | 41.5 |
| | hardness | 90 | 160 | 125 | 105 |
| | references | — | ageing treatment | ageing treament | ageing treatment |

TABLE 3

| | | characteristics | | | | | |
|---|---|---|---|---|---|---|---|
| | material | density | thermal conductivity | insulating withstand voltage | thermal expantion | bending strength | sintering |
| specimen I | BeO | 2.9 | 247 W/m k | 10~14 KV/mm | $7.2 \times 10^{-6}$ | 17~23 kg/mm² | normal pressure |
| specimen II | AlN | 3.3 | 100~180 | 14~17 KV/mm | $4.5 \times 10^{-6}$ | 40~50 kg/mm² | normal pressure |
| specimen III | BN | 2.3 | 167~59 | 1 KV/mm | $5 \times 10^{-6}$ | 3~8 kg/mm² | normal pressure |
| specimen IV | SiC | 3.2 | 268 | 0.07 KV/mm | $3.7 \times 10^{-6}$ | 45 kg/mm² | hot press |
| specimen V | $Al_2O_3$ | 3.9 | 18 | 10 KV/mm | $7.3 \times 10^{-6}$ | 20~30 kg/mm² | normal pressure |

The test is carried out by incrementally changing an ignition advance angle with 4-cylinder 2000cc engine employed.

Figure 2:
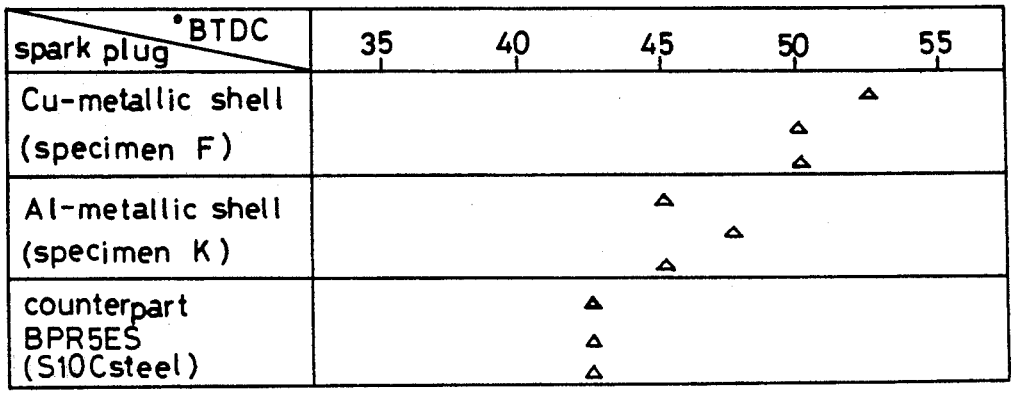
FIG. 2 is a graph showing heat resistance when an insulator of alumina and various metallic shells.

As a result, it is found that the heat resistance has been improved by the angle of 2.5–7.5 degrees as seen in FIG. 2.

In the meanwhile, among the specimens I–V indicated at Table 3, (BEO) and (A1N) are acceptable in view of the thermal conductivity, the withstand voltage and the bending strength.

Experiment was carried out with the insulator of specimen F assembled to the metallic shells of copper alloy and (S10C) steel.

Figure 3:
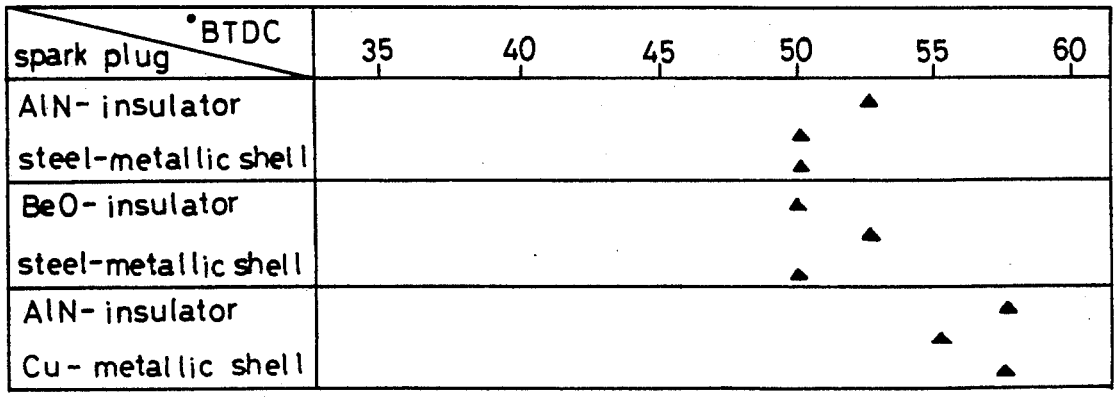
FIG. 3 is a graph showing heat resistance when an insulator of AlN and BeO is applied.

Combination of the (A1N)-insulator and the copper metallic shell has made it possible to significantly improve the heat resistance as seen FIG. 3.

Figure 4:
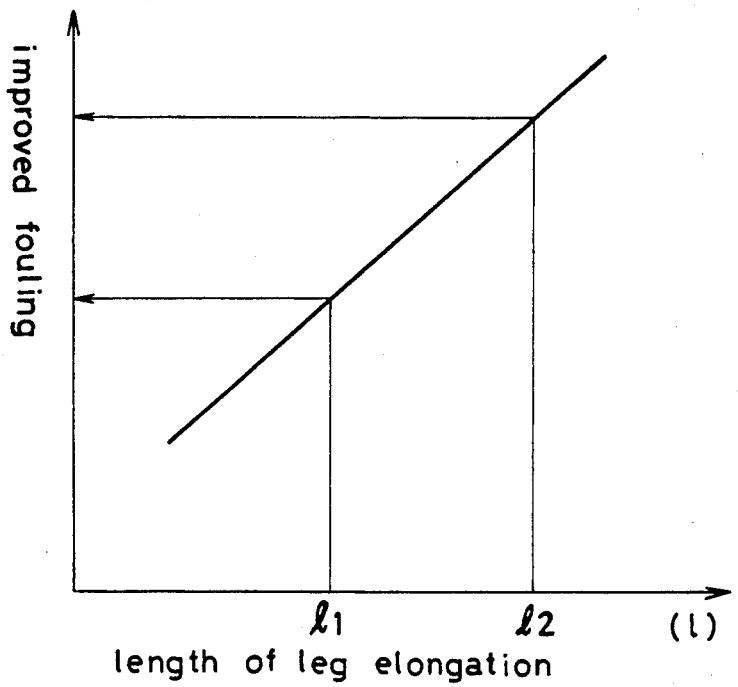
FIG. 4 is a graph showing relationship between length of insulator and fouling.

The improved heat resistance leads to lengthening the leg elongation of the insulator from ($1^1$) to ($1^2$) as seen in FIG. 4, and at the same time, enhancing fouling resistance.

In this experiment, each cycle is formed by combining factors of racing - idling - 15 (Km/h) - 35 (Km/h) at a room temperature of ten freezing degrees Celsius. These cycles are repeated, so that fouling is estimated when the engine inadvertently stops, otherwise failing to make the engine restart.

Figure 5:
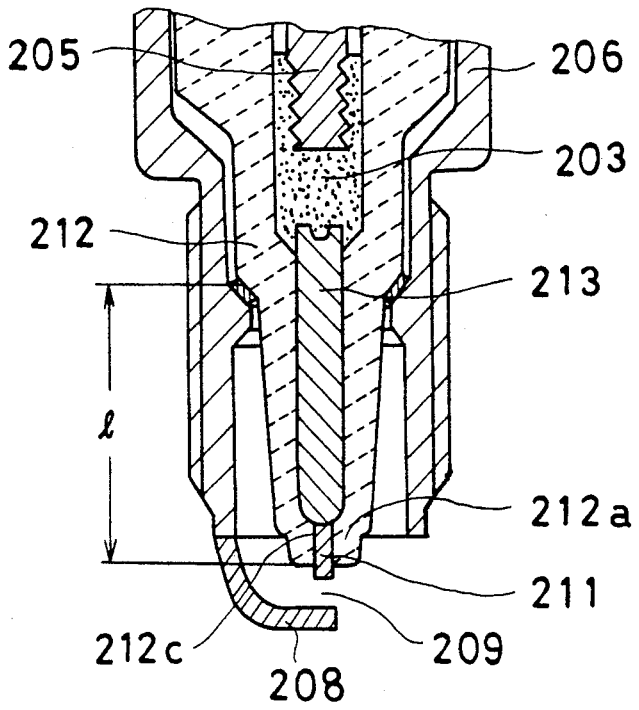
FIG. 5 is an enlarged main part of a spark plug body according to a further modification form.
Figure 6:
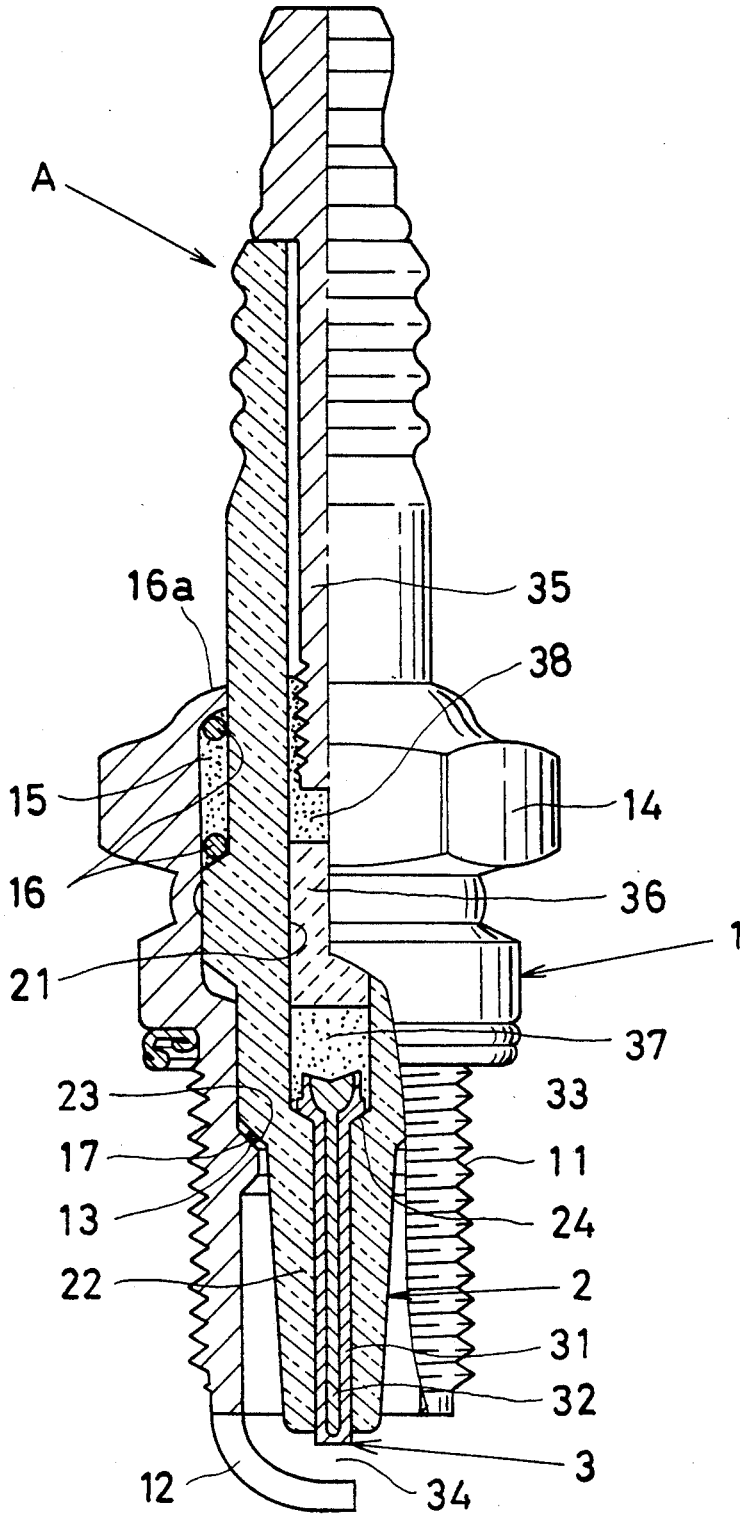
FIG. 6 is a longitudinal cross sectional view of a spark plug body.

As another modification of this invention, a tubular insulator 212 is made of (BeO) and (A1N) as seen in FIG. 5. The insulator 212 is integrally sintered with platinum (Pt) alloyed wire placed into a small hole 212*c* to form a center electrode 211. The small hole 211*c* is provided at a leg elongation 212*a*. The platinum (Pt) alloy of the center electrode 211 is made of (Pt-Ir), (Pt-Rh) or the like.

The center electrode 211 is connected to a middle electrode 213 and a terminal 205, and rigidly secured by means of an electrically conductive adhesive 203. The insulator 212 is combined with a metallic shell 206 which is in accordance with copper alloy and aluminum alloy as listed at Tables 1, 2. In the spark plug having the insulator 212 thus integrally sintered with the center electrode 211, the heat resistance becomes somewhat reduced. However, combination of the insulator 212 and the metallic shell according to this embodiment, makes it possible to compensate for the reduction of the heat resistance.

The insulator 212 of this type is particularly useful for a small scale spark plug (10 mm -8 mm in diameter of a male screw) since it is possible to make the center electrode 211 thin, at the same time, making the diameter of the insulator 212 reduced with high heat resistant property maintained. It is noted that numerals 208 and 209, in turn, designate a ground electrode and a spark gap.

Referring now to FIGS. 6 through 10, a spark plug body (A) according further embodiment of the invention, has a cylindrical metallic shell 1 and an insulator 2 which has an axial center bore 21. Into the center bore 21 of the insulator 2, a center electrode 3 is concentrically inserted. The metallic shell 1 is made of pure copper which has a hardness of HRB 58 at normal temperature, and having a hardness of HRB 15 at the temperature of 350 degrees Celsius with an electrical conductivity of IACS 100% (20° C.), a thermal conductivity of 390 W/m·k and 35 Kg/mm$^2$ of tensile stress resistance.

After melting the copper by heat, an alumina ($A1_2O_3$) powder of 0.85 weight percentage, spherical diameter of which is 1 micron, is evenly dispersed into the melted copper to form an alumina-dispersed copper.

The alumina-dispersed copper thus made, is manufactured by plastic working in which 60% of all the manufacturing process in by means of cold deforming process.

The properties of the alumina-dispersed copper is shown in Table 4.

TABLE 4

| | |
|---|---|
| melting point (°C.) | 1082 |
| specific weight 20° C. (g/cm$^3$) | 8.78 |
| electrical conductivity 20° C. IACS (%) | 80 |
| thermal conductivity 20° C. (W/m · k) | 320 |
| electrical resistance 20° C. (μΩ · cm) | 13.00 |
| thermal expansion (cm/cm/°C.) | 20.4 × 10$^{-6}$ |

Further, the metallic shell 1 has a threaded surface 11 at its rear end to be screwed to a cylinder head of an internal combustion engine, and at the same time, having a middle barrel and a rear caulking pad 16*a*. From a front end of the metallic shell 1, a J-shaped ground electrode 12 is depended by means of welding to form a spark gap with a front end of the center electrode 3. An inner surface of the metallic shell 1 has a shoulder portion 13 on which an annual packing 17 is received. In proximity of the caulking pad 16a, a hexagonal ring nut 14 is provided. The caulking pad is inturned to retain the tubular insulator 2 together with a line packing 16 and an annular talc 15. The insulator 2 is of a sintered ceramic body of aluminum nitride (A1N) which has a thermal conductivity of 180 W/m·k (20° C.). The insulator 2 has a leg elongation 22 at its front portion, upper end of which has a tapered surface at its outer surface, and supported by the metallic shell 1 with the tapered surface engaged against the shoulder portion 13 by way of the packing 17.

In the meanwhile, diameter of the center bore 21 is somewhat reduced at the leg elongation 22, and that of the bore 21 is increased through a step portion 24 at a portion somewhat behind a tapered surface 23.

The center electrode 3 is made of a copper core 32 clad by heat-resistant nickel alloy 31. A rear end of the center electrode 3 has a flanged head 33 to engage with the step portion 24, while a front end of the center electrode 3 meet the ground electrode 12 with the spark gap interposed. The peripheral space surrounding the spark gap comes to serve as a firing tip 34. The flanged head 33 is connected to a terminal 35 by sandwiching a resistor 36 by means of electrically conductive glass sealants 37, 38.

Figure 7:
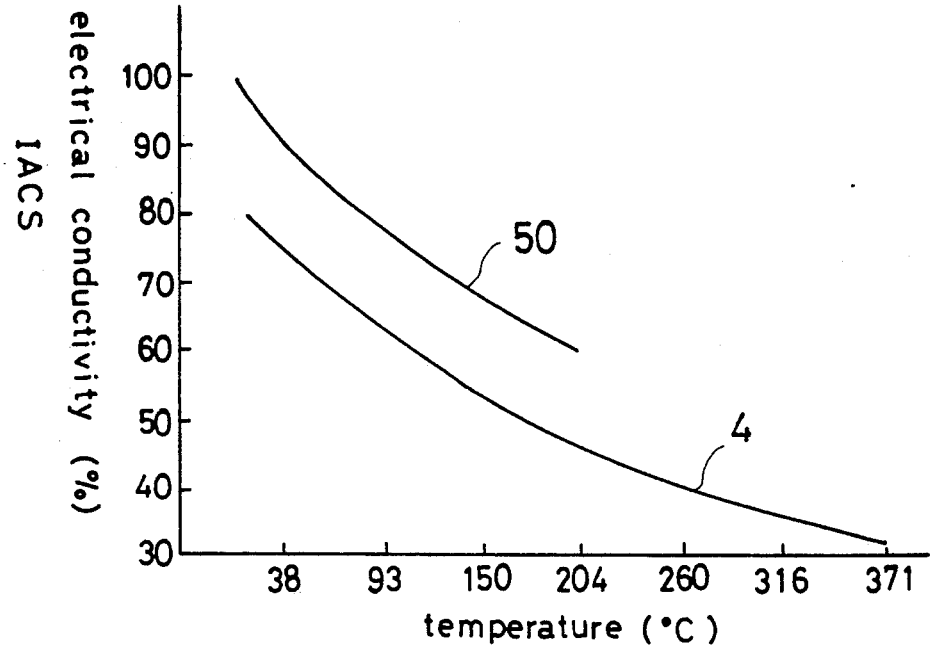
FIG. 7 is a graph showing relationship between temperature and thermal conductivity

The metallic shell 1 thus far made of the alumina-dispersed copper alloy, is as follows:

(a) The alumina-dispersed copper alloy has an electrical conductivity of IACS 80 % (20° C.), and a thermal conductivity of 320 W/m·k as seen at Table 4 and at a curve (4) in FIG. 7.

The high electrical and thermal conductivity of copper are generally maintained.

Figure 8:
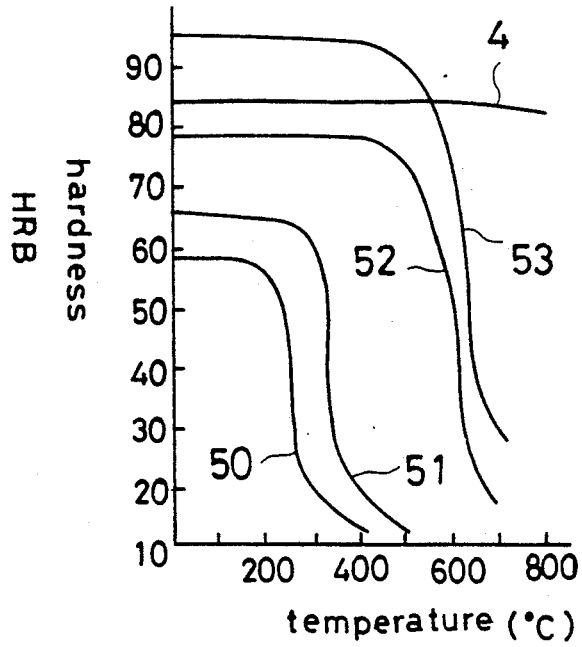
FIG. 8 is a graph showing relationship between temperature and hardness.

(b) FIG. 8 shows hardness in which numerals 50, 51, 52 and 53 in turn correspond to pure copper, (CdCu), (CrCu) and (BeCu). According the curve 4 of FIG. 8, the alumina-dispersed copper shows its hardness of HRB 84.5 at normal temperature, and hardness of HRB 80 at 800 degrees Celsius which indicates that the hardness of the alumina-dispersed copper has significantly improved compared to the hardness of the pure copper (see at curve 50). In the alumina-dispersed copper, the dispersed alumina powder acts as a barrier of dislocation to increase recrystallization of the pure copper, avoiding the dispersed alumina powder from being solved in the phase of the pure copper.

Among other metallic alloys, (BeCu) shows its hardness of HRB 95 below 400 degrees Celsius, however, its hardness rapidly deteriorates at the temperature of 200 -400 degrees Celsius.

Figure 9:
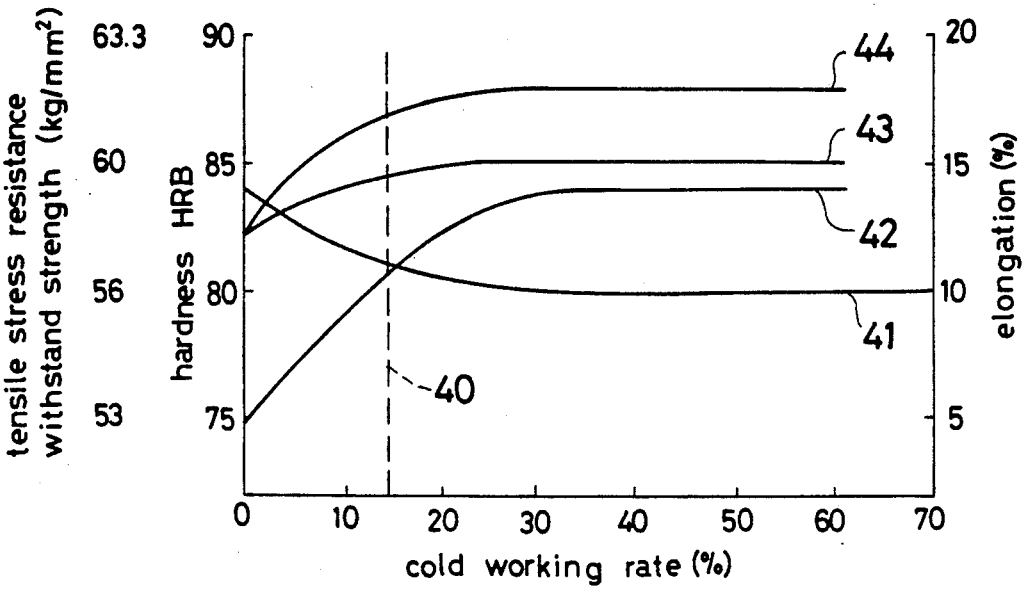
FIG. 9 is a graph showing relationship between cold working rate and mechanical strength.

(c) FIG. 9 shows relationship between percentage of cold working and mechanical strength of the alumina-dispersed copper alloy. In FIG. 9, the numerals 41, 42 43 and 44 in turn represent an elongation rate (%), a withstand strength, a hardness HRB and a tensile stress resistance (Kg/mm$^2$).

According to FIG. 9 with broken lines 40 indicating cold working rate as 14 percent, it is found that the higher the percentage of cold working becomes, the less the mechanical strength deteriorates.

Figure 10:
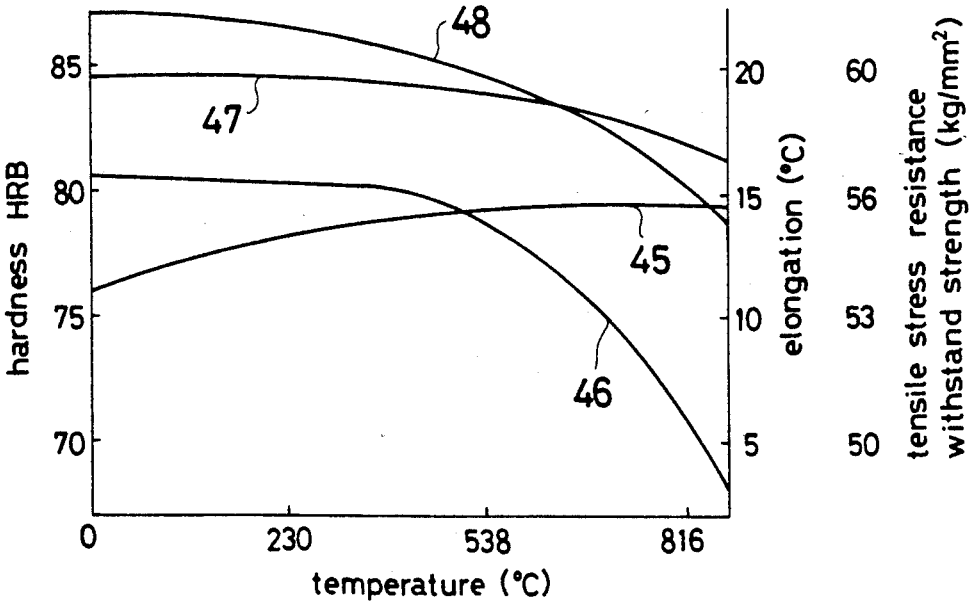
FIG. 10 is a graph showing relationship between cold working rate and mechanical strength with the cold working rate as 14 percent after one hour passed at each temperature.

FIG. 10 shows a mechanical strength with the cold working rate as 14 percent, the numerals 45, 46, 47 and 48 in turn represent an elongation rate (%), a withstand strength, a hardness HRB and a tensile stress resistance ($Kg/mm^2$) after releasing for one hour at high temperature.

As seen FIG. 10, it is found that good mechanical strength is maintained in some degrees even though a considerable are employed.

Some experiments are conducted as follows to compare the metallic shell 1 with a counterpart metallic shell which is made of (S10C) steel.

Preignition resistance test

It is found that ignition advance angle has improved by the angle of 5–7.5 degrees with 4-cylinder 2000cc engine employed.

Fouling resistance test

Each cycle is formed by combining factors of racing-idling - 15 (Km/h) - 35 (Km/h) at the room temperature ten freezing degrees Celsius with 4-cylinder 20000cc engine employed. These cycles are repeated, so that fouling is estimated when the engine inadvertently stops, otherwise it fails to make the engine restart.

As a result, it is found that the appropriate ignition is ensured at the cycles in which the engine stop or the restart failure apparently occurs at the counterpart.

It is appreciated that zirconium oxide ($ZrO_2$), or aluminum nitride (A1N) powder may be used instead of alumina powder. A plurality of the ceramic powders may be dispersed as long as the weight percentage falls within the range from 0.3 percent to 3.0 percent. Preferably, the spherical diameter of ceramic powder may be in less than 1 micron.

It is also noted that only the leg elongation of the insulator may be made of aluminum nitride (A1N), and other kinds of ceramics may be added as long as the thermal conductivity at least remains at 60 W/m·k (0.1435 cal sec° C.).

Figure 11:
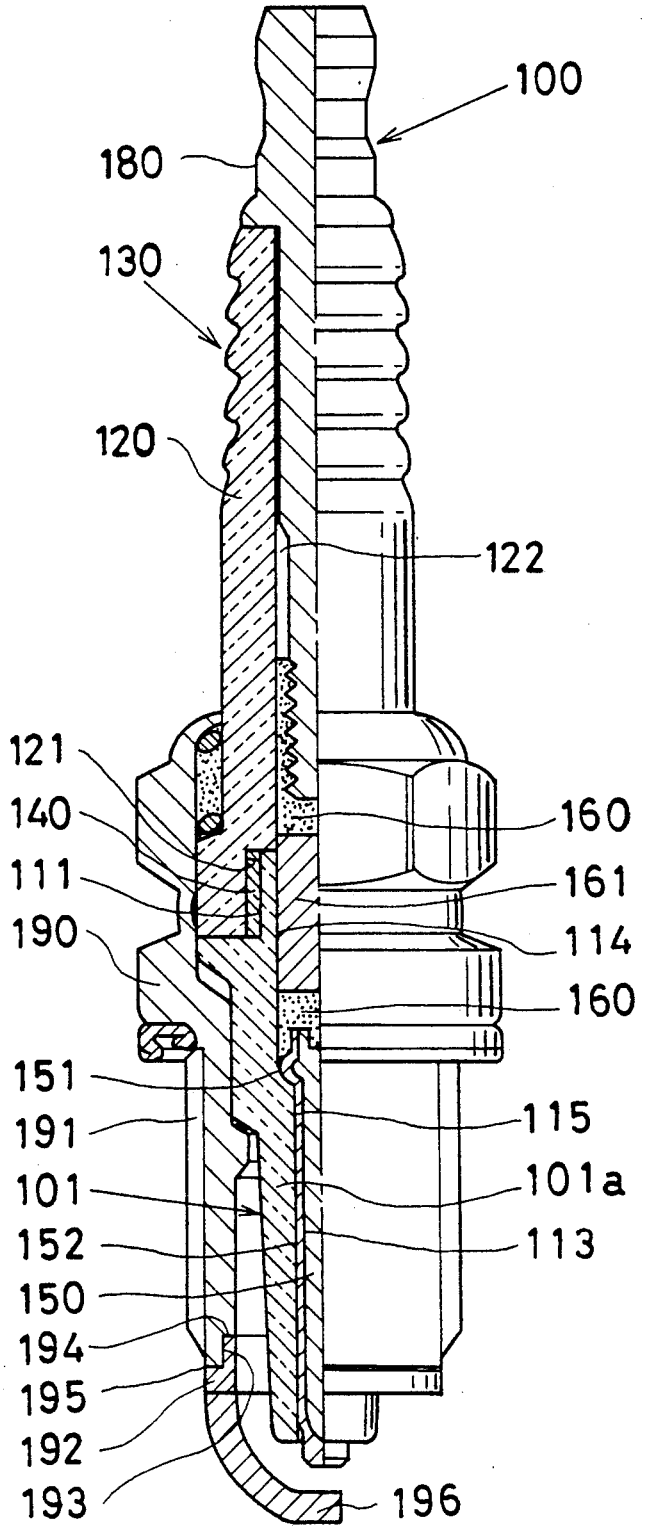
FIG. 11 is a longitudinal cross sectional view of a spark plug body according to another embodiment of the invention.
Figure 12:
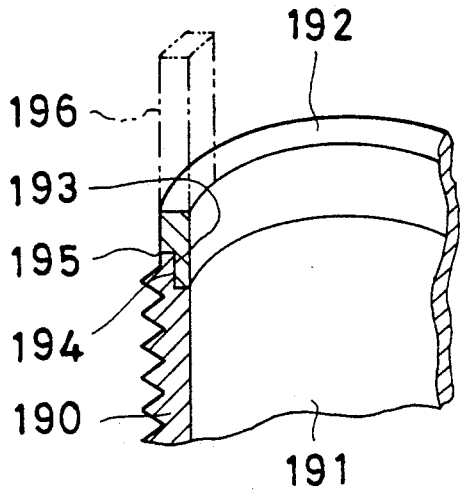
FIG. 12 is a partially sectioned view of a main part according to another embodiment of the invention.
Figure 13:
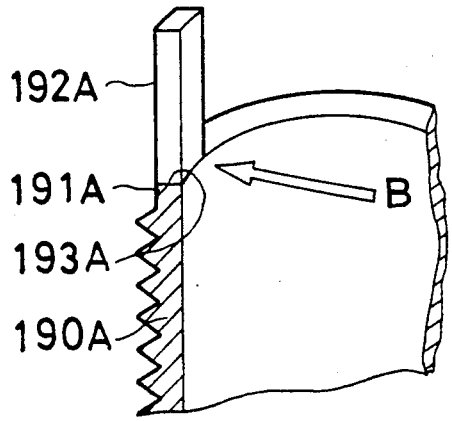
FIG. 13 is a partially sectioned view of a prior art counterpart.

Referring to FIGS. 11 through 13, another embodiment of the invention is described hereinafter. A spark plug body 100 has a cylindrical metallic shell 190, a main part 191 of which is made of aluminum alloy or copper alloy which has a good thermal conductivity of more than 60 W/m·k. An annular ring 192 is provided to be connected to a front end of the metallic shell 190. The ring 192 is made of heat-resistant metal such as steel, stainless steel or nickel alloy. An inner surface of the metallic shell 190 has a step portion 193, while an outer suriace of the ring 192 has a step portion 194. The two step portions 193 and 194 are telescopically interfit each other, and rigidly connected by means of well-known welding 195 such as laser welding, electron-welding, TIG (tungsten inert gas welding) or soldering. From the annular ring 192, a J-shaped ground electrode 196 which is made of a heat resistant nickel alloy, is depended to form a spark plug gap with a center electrode 150 described hereinafter.

A tubular insulator 101 includes a front piece 101a, and is concentrically placed within a front portion of the metallic shell 190. The front half piece 101a of the insulator 101 acts as a leg elongation, and made of aluminum nitride (A1N) having a good thermal conductivity of more than 60 W/m·k. The rear hali piece 120 is made of relatively inexpensive alumina ($A_1O_3$).

However, it is a matter of course that the rear half piece 120 may be made of aluminum nitride (A1N).

In the meanwhile, a rear end of the front half piece 101a of the insulator 101 has a concentrical projection 111 which interfit into a recess 121 provided at a front end of the rear half piece 120 to form a joint-type insulator 130. The two pieces 120 and 101*a* are, as seen in FIG. 11, interfit in a manner of mortise-tenon joint by means of glass sealant 140 which is a mixture of ceramic components such as (CaO), (BaO), ($A1_2O_3$), ($SiO_2$) and the like.

The front half piece 101*a* has an axial center bore 115 consisting of a diameter-reduce hole 113 and a diameter-increased hole 114. The rear half piece 120 has a bore 122 axially communicating with the diameter-increased hole 114. Into the bores 113 and 114, the center electrode 150 is concentrically inserted with its front end somewhat extended from that of the front half piece 101*a*. The center electrode 150 is made of a copper core clad by a heat-resistant nickel alloy, and having a flanged head 151 at its rear end.

At the assemble process, the center electrode 150 is inserted from the rear end of the bores 115, 122 with the flanged head 151 received by a shoulder of the diameter-increased hole 114, and secured by means of a heat-resistant inorganic adhesive 152 at the diameter-reduced hole 113. Into the bores 115, 122, an electrically conductive glass sealant 160 is provided to sandwich a noise-suppression resistor 161. A terminal 180 is inserted into the bore 122, and secured by means of the conductive glass sealant 160.

According to the embodiment of the invention, the annular ring 192 is welded to the metallic shell 190 by way of the step portions 193 and 194, thus strengthening the connection, and avoiding the connection from being oxidized.

The nickel-alloyed ground electrode 196 is directly welded to the annular ring 192 which has made of metal similar to the ground electrode 196.

Therefore, it becomes possible to strengthen the welding connection between the ring 192 and the ground electrode 196.

In contrast, in the prior cases in which a nickel alloyed ground electrode 192*A* is welded to a copper alloyed metallic shell 190*A* as seen at arrow (B) in FIG. 13, mechanical strength at a connection 93*A* is short of desired level. In addition, the copper alloy component at 191*A* is subjected to corrosion due to oxidation, thus deteriorating the welding strength.

It will be understood that various changes and modifications may be made in the above described systems which provide the characteristics of this invention without departing from the spirit thereof.

What is claimed is:

1. A spark plug structure comprising;
a cylindrical metallic shell;
a tubular insulator having a center bore, and;
a center electrode placed into the center bore of the insulator to form a spark gap with a ground electrode depending from the metallic shell;
the metallic shell being made of material having a tensile stress of more than 40 $Kg/mm^2$, and having a thermal conductivity of more than 60 W/m·k.

2. A spark plug structure as recited in claim 1, in which the metallic shell has a tensile stress of more than 40 $Kg/mm^2$, and a thermal conductivity of more than 60 W/m·k, while the insulator has a thermal conductivity of more than 60 W/m·k with a withstand voltage of more than 10 KV/mm, and a bending stress of more than 15 $Kg/mm^2$.

3. A spark plug structure as recited in claim 2, in which the insulator is sintered in integral with the center electrode.

4. A spark plug structure as recited in claim 2, in which the metallic shell is made of ceramic-dispersed copper alloy including a copper into which a ceramic powder is dispersed within the range from 0.3 weight percentages to 3.0 weight percentages.

5. A spark plug structure as recited in claim 4, in which the ceramic powder is alumina ($A1^2O_3$). Zirconium oxide ($ZrO_2$) and aluminum nitride (A1N).

6. A spark plug structure comprising;

a cylindrical metallic shell having a ground electrode at its front end which has a thermal conductivity of more than 60 W/m·k;

a tubular insulator having a center bore, and at least a front end of the insulator having a good thermal conductivity of more than 60 W/m·k, and placed into the metallic shell;

a center electrode placed into the center bore of the insulator with a front end somewhat extended from that of the insulator;

a terminal inserted into the center bore of the insulator in alignment with the center electrode;

an electrically conductive glass sealant provided at an annular space between the insulator and the terminal, and one between the insulator and the center electrode;

the ground electrode being made of nickel or nickel alloy, the ground electrode being connected to the metallic shell through a metallic ring which is made of different metal from the metallic shell selected from the group consisting of steel, stainless steel and nickel alloy.

7. A spark plug structure as recited in claim 6, in which an inner surface of the metallic shell has a step portion, while an outer surface of the metallic ring having a step portion to connect two step portions by means of laser beam welding, electron-beam welding, tungsten inert gas arc welding or soldering.

* * * * *